United States Patent [19]

Dixon

[11] 4,321,712

[45] Mar. 30, 1982

[54] DEGREASING APPARATUS

[76] Inventor: Raymond F. Dixon, Rte. 4, Box 100 D, Hopkins, S.C. 29061

[21] Appl. No.: 193,360

[22] Filed: Oct. 2, 1980

[51] Int. Cl.[3] ..... E03D 11/00

[52] U.S. Cl. ..... 4/256; 4/255

[58] Field of Search ..... 4/255, 256, 257

[56] References Cited

U.S. PATENT DOCUMENTS

| | | | |
|---|---|---|---|
| 831,722 | 9/1906 | Holmes | 4/256 |
| 1,605,749 | 11/1926 | McCarthy | 4/256 X |
| 1,745,923 | 2/1930 | Frizzell | 4/256 |
| 1,817,376 | 8/1931 | Izquierdo | 248/193 R |
| 1,821,789 | 9/1931 | Borgeson | 4/256 |
| 1,885,977 | 11/1932 | Denison | 4/256 |
| 1,988,198 | 1/1935 | German | 4/256 |
| 1,994,526 | 3/1935 | McCloskey | 4/356 |
| 2,535,092 | 12/1950 | Rettinger | 4/256 |
| 3,526,547 | 9/1970 | Shock | 134/22 |
| 3,936,892 | 2/1976 | Miller | 4/256 |
| 4,031,914 | 6/1977 | Neri | 137/247.51 |
| 4,121,948 | 10/1978 | Guhlin | 134/100 |
| 4,179,762 | 12/1979 | Barnhardt et al. | 4/191 |

*Primary Examiner*—Henry K. Artis

*Attorney, Agent, or Firm*—Benoni O. Reynolds

[57] ABSTRACT

A degreasing apparatus which utilizes hot water under pressure from a sink faucet to inject a degreasing solution directly into a blocked U-trap or downstream sewerage system. The degreasing apparatus consists of a small pipe elbow permanently affixed at one end to the output nozzle of a liquid dispenser and provided at the other end with a female hexagonal coupling nut for attaching the apparatus to standard U-traps. To use the apparatus, the input of the liquid dispenser is coupled by a conventional washing hose to the hot water faucet of the blocked sink. The output end of the degreasing apparatus is coupled to the input of the U-trap after the trap is uncoupled from the drain pipe of the sink. After tightening the hexagonal coupling nuts of the U-trap, the degreasing apparatus permits the injection of a degreasing solution from the liquid dispenser container at maximum pressure into a blocked U-trap or downstream sewerage system relying solely on the water pressure provided by the faucet of the sink.

1 Claim, 2 Drawing Figures

FIG. 1.
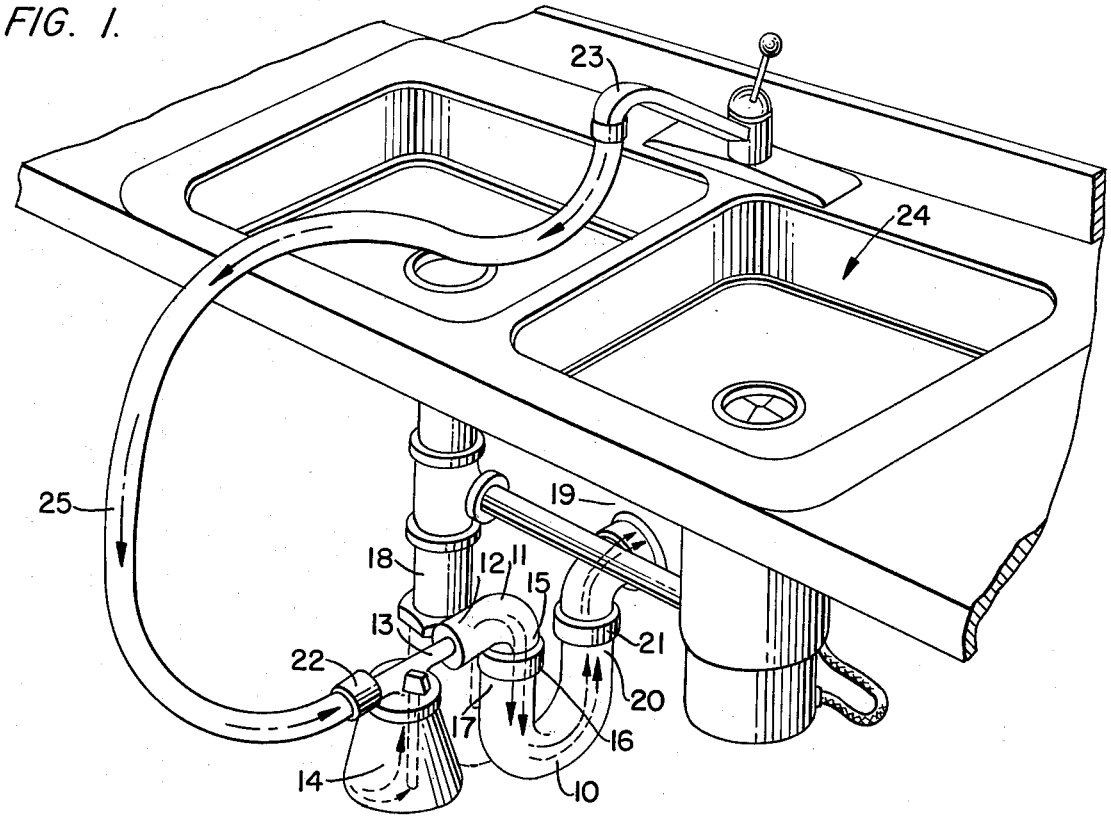
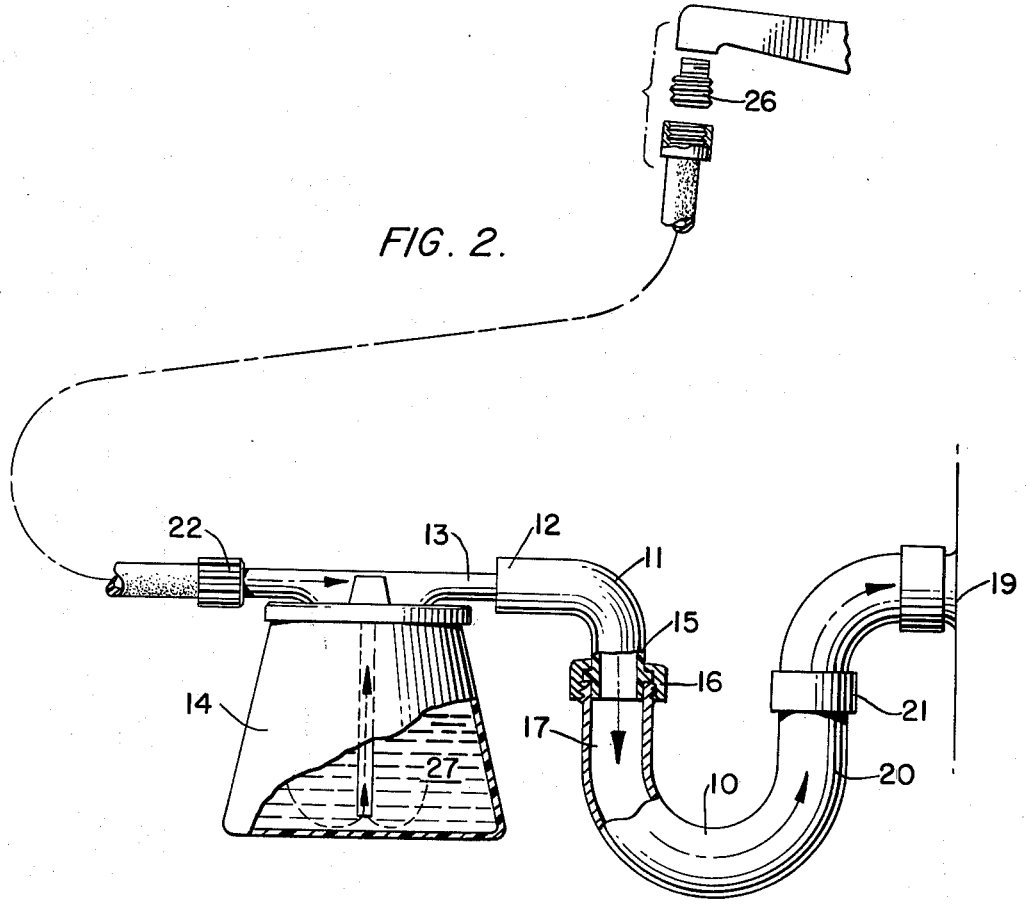
FIG. 2.

DEGREASING APPARATUS

BACKGROUND OF THE INVENTION (1) Field of Invention:

This invention relates to apparatus for degreasing blocked U-traps of sinks or sewerage systems downstream of the traps.

(2) Description of Prior Art:

Most homes do not have apparatus for efficiently unstopping a blocked U-trap under a sink or removing blockage occurring elsewhere in the pipes downstream from the U-trap. Generally the homeowner must rely on rubber plunger devices or disassembling the entire U-trap for manually cleaning it out. Either alternative is laborious, time consuming and may be a futile effort if the blockage is downstream of the sink trap.

Various forms of apparatus designed for the same purpose are known in the art but most devices require special fittings, usually permanent in nature, which are complicated and expensive. None of the prior devices combine the readily available advantages of faucet water pressure and the introduction of a proper solution of degreasing agent into the blocked area. Grease tends to build gradually on the walls of the piping and unless the grease, as well as the blockage debris, is removed, the homeowner has only temporarily solved his problem. None of the prior art provides for use with double sinks, dishwashers, garbage grinders and other interconnecting devices without the use of separate valves, stoppers or other auxilliary components to prevent the back-flooding of debris and water which occurs in the unblocking process. Other devices lose the effect of backpressure entirely which detracts from the volume of pressure applied to debris removal. Most of the prior art devices are limited to just the problem of U-trap obstruction; there is no provision for removing obstructions downstream of the trap. Some of the devices use air which is not as effective as water pressure. Those devices which seek to use faucet pressure use it inefficiently. Other devices are purely filters or rely on a mechanical cleanout which is only a temporary solution.

Prior Art known to this inventor includes the following U.S. Patent Numbers:

| | | |
|---|---|---|
| 1,605,749 | 11/1926 | McCarthy |
| 1,745,923 | 2/1930 | Frizzell |
| 1,817,376 | 8/1931 | Izquierdo |
| 1,994,526 | 3/1935 | McCloskey |
| 3,526,547 | 9/1970 | Shock |
| 3,936,892 | 9/1974 | Miller |
| 4,031,914 | 6/1977 | Neri |
| 4,121,948 | 10/1978 | Guhlin |
| 4,179,762 | 12/1979 | Barnhardt, et al. |

BRIEF SUMMARY OF INVENTION

The present invention is a degreasing apparatus in which the hot water under pressure from a sink is utilized to inject a degreasing solution from a liquid dispenser directly into a blocked U-trap or blocked piping downstream from the U-trap used as access. Because of the few, simple components of the present invention, it is easily and inexpensively manufactured and is reliable in operation. As its configuration is compact and self-contained, the present invention is easily installed and used. Also it is easily removed and stored for later use.

According to the preferred embodiment of this invention, the basic component is a small pipe elbow made of PVC or other light weight but strong material. The output nozzle of a conventional liquid dispenser is permanently mounted and sealed into one end of the small pipe elbow with hypoxy or other waterproof sealant. The other end of the elbow is provided with a female hexagonal coupling nut for fastening the small pipe elbow to a standard U-trap.

To use the degreaser apparatus, the input of the U-trap serving as an access point must be first uncoupled from the drain pipe of the sink. The output end of the U-trap remains attached to the ongoing plumbing but is loosened at the coupling so that the U-trap can swivel freely. The output end of the degreasing apparatus is then coupled to the input of the U-trap and the securing hexagonal coupling nuts on both ends of the U-trap are tightened. The input of the liquid dispenser is then coupled to the hot water faucet of the blocked sink by means of a conventional washing machine hose with appropriate adapters, if needed. When the faucet is turned on, the degreaser solution in the detergent container is injected with considerable pressure into the blocked U-trap or piping downstream of the trap.

OBJECTIVES OF THE INVENTION

The objectives of the present invention are to provide a degreasing apparatus for general use in unstopping blocked U-traps of sinks and downstream sewerage systems which is:

(1) capable of being installed and used by a novice;

(2) capable of use without elaborate, permanent, special fittings.

(3) self-contained and requiring no separate means for preventing backup of water and debris when degreaser unit is used;

(4) capable of use on double sinks and where the presence of interconnecting dishwashers, garbage grinders, or other devices pose a backflooding problem;

(5) capable of use with readily available sources of pressure;

(6) capable of providing more direct and greater pressure than devices known in prior art designed to perform the same function;

(7) more simple and inexpensive to manufacture than devices known in prior art designed for the same function;

(8) capable of unblocking not only the U-trap of a sink but any downstream blockage in the sewer system as well;

(9) capable of introducing a proper solution of degreasing agent for a complete and efficient degreasing of the U-trap and any downstream sewerage system.

BRIEF DESCRIPTION OF DRAWINGS

FIG. 1 is a perspective view from the right front of a degreaser apparatus constructed in accordance with the principles of the present invention, showing the apparatus as installed and used in degreasing the U-trap or downstream plumbing of a modern-day double sink. Arrows show the path of the water from the faucet, through the degreaser apparatus to the U-trap.

FIG. 2 is a fragmentary side elevational view of the degreaser apparatus showing details of the liquid dispenser the small pipe elbow and its hexagonal coupling nut for attachment to a U-trap. Arrows again show the general path of the water and degreasing solution.

DETAILED DESCRIPTION OF THE PREFERRED EMBODIMENT OF THE INVENTION

The degreaser apparatus is a compact, small unit which in its best mode of operation is easily and quickly installed by any novice handyman with access to the underside of a blocked sink. Throughout the following detailed description of the present invention like reference numerals are used to denote like parts disclosed in the accompanying drawings, FIGS. 1 and 2. As shown in FIG. 2, the degreaser apparatus is designed for attachment to the input 17 of a U-trap indicated generally by reference numeral 10. Small pipe elbow 11, composed of PVC or other light weight but strong material, is permanently mounted and sealed at its input end 12 to the output nozzle 13 of a conventional liquid dispenser, indicated generally by reference numeral 14. An hypoxy or other similar sealant is used to provide a watertight juncture of output nozzle 13 and input end 12 of small pipe elbow 11. Output end 15 of small pipe elbow 11 is provided with a female hexagonal coupling nut 16 for fastening small pipe elbow 11 to input 17 of standard U-trap 10 after it has been disconnected from sink drain pipe 18.

As best illustrated by FIG. 1, input 17 of U-trap 10 serves as the access point to blocked U-trap 10 or downstream piping 19. To use the degreaser apparatus, input 17 must first be uncoupled from sink drain pipe 18 and swung forward to where the input is accessible to the installer. Output end 20 of U-trap 10 remains attached to the ongoing plumbing but hexagonal coupling nut 21 must be loosened so that U-trap 10 can temporarily swivel freely. Output end 15 of small pipe elbow 11 is then coupled to input 17 of U-trap 10 and securing hexagonal coupling nuts 16 and 21 are tightened to provide a water tight connection of the degreaser apparatus to the sewerage system. Input 22 of liquid dispenser 14 is then coupled to hot water faucet 23 of blocked sink, indicated generally as reference numeral 24, by conventional washing machine hose 25 with adapter 26, if needed. When hot water faucet 23 is turned on, hot degreaser solution 27 in liquid dispenser 14 is injected with hot water under considerable pressure into blocked U-trap 10 or downstream piping 19 that may be similarly blocked by grease or other obstruction.

I claim:

1. In combination with a blocked sink, hot water faucet, conventional washing machine hose and conventional liquid dispenser, an apparatus for degreasing or unblocking the U-trap of said blocked sink and its downstream piping, from a position in front of said blocked sink, comprising:

a small pipe elbow having an input end and an output end, a hexagonal female coupling nut which mates said output end of said small pipe elbow to the input of said U-trap of said blocked sink after said U-trap has been uncoupled from sink drain pipe of said blocked sink, said conventional liquid dispenser whose output nozzle is permanently mounted and sealed to said input end of said small pipe elbow for the purpose of injecting a mixture of hot water and degreasing solution into said small pipe elbow, said attached U-trap and downstream piping connected to said U-trap, said conventional washing machine hose whose upper end mates with said hot water faucet of said blocked sink and whose lower end mates with the input of said conventional liquid dispenser for the purpose of conveying hot water from said hot water faucet to said conventional liquid dispenser and said attached small pipe elbow.

* * * * *